US011656562B2

(12) United States Patent
Tamai et al.

(10) Patent No.: US 11,656,562 B2
(45) Date of Patent: May 23, 2023

(54) DEVELOPING DEVICE WITH TRANSPORTING MEMBER AND COOLING UNIT FIXED TO A CASE

(71) Applicant: FUJIFILM BUSINESS INNOVATION CORP., Tokyo (JP)

(72) Inventors: Tatsuya Tamai, Ebina (JP); Atsushi Funada, Ebina (JP); Mitsutoshi Hongo, Ebina (JP); Mizue Sekine, Ebina (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 0 days.

(21) Appl. No.: 17/460,510

(22) Filed: Aug. 30, 2021

(65) Prior Publication Data

US 2022/0373932 A1 Nov. 24, 2022

(30) Foreign Application Priority Data

May 20, 2021 (JP) ..... JP2021-085595
May 20, 2021 (JP) ..... JP2021-085596
May 20, 2021 (JP) ..... JP2021-085597

(51) Int. Cl.
*G03G 15/08* (2006.01)
*G03G 21/20* (2006.01)

(52) U.S. Cl.
CPC ..... *G03G 15/0891* (2013.01); *G03G 15/0812* (2013.01); *G03G 15/0817* (2013.01); *G03G 15/0896* (2013.01); *G03G 21/206* (2013.01); *G03G 2215/0132* (2013.01)

(58) Field of Classification Search
CPC ..... G03G 15/0891; G03G 15/0812; G03G 15/0817; G03G 2215/0132; G03G 21/206; G03G 21/1832; G03G 15/0896; G03G 15/0898; G03G 2221/1645; G03G 2221/1648
See application file for complete search history.

(56) References Cited

U.S. PATENT DOCUMENTS

2009/0269098 A1* 10/2009 Mori ..... G03G 15/0891 399/94
2016/0026113 A1* 1/2016 Takahashi ..... G03G 15/065 399/285
2018/0267429 A1* 9/2018 Okuno ..... G03G 15/0865

FOREIGN PATENT DOCUMENTS

EP 2395400 A2 * 12/2011 ..... G03G 15/0808
JP 2003-114577 A 4/2003

* cited by examiner

*Primary Examiner* — Arlene Heredia
*Assistant Examiner* — Laura Roth
(74) *Attorney, Agent, or Firm* — Oliff PLC

(57) ABSTRACT

A developing device includes: a case in which a hollow transporting path is formed; a transporting member configured to transport a developer in the transporting path; a support portion fixed to an end portion of the case by a fastening member to support the transporting member at an end portion of the transporting path; and a cooling unit fixed by being sandwiched between the support portion and the case.

16 Claims, 10 Drawing Sheets

DEVELOPING DEVICE WITH TRANSPORTING MEMBER AND COOLING UNIT FIXED TO A CASE

CROSS-REFERENCE TO RELATED APPLICATIONS

This application is based on and claims priority under 35 USC 119 from Japanese Patent Application No. 2021-085595 filed on May 20, 2021, Japanese Patent Application No. 2021-085596 filed on May 20, 2021, and Japanese Patent Application No. 2021-085597 filed on May 20, 2021.

BACKGROUND

Technical Field

The present invention relates to a developing device.

Related Art

JP-A-2003-114577 discloses a developing device having a developer container in which a developer is contained, an agitator configured to transporting the developer while agitating the developer, a developing sleeve configured to rotate by adsorbing the developer transported by the agitator on a surface thereof, and a developing blade arranged with a uniform minute gap on the surface of the developing sleeve and for thinly and uniformly regulating an adsorption amount of the developer adsorbed on the surface of the developing sleeve; and an image forming apparatus including the developing device, the developing device including at least one cooling unit of a cooling unit in contact with the agitator inside the developer container to absorb the heat of the agitator, a cooling unit in contact with the developing sleeve inside the developer container to absorb the heat of the developing sleeve, and a cooling unit in contact with the developing blade inside the developer container to absorb the heat of the developing blade, in which a heat radiating portion of the cooling unit is disposed outside the developer container and outside a transporting region of a transfer member in a view seen from the top of the image forming apparatus.

SUMMARY

Aspects of non-limiting embodiments of the present disclosure relate to a developing device in which a cooling member is fixed to a case with a simple structure as compared with a structure in which a cooling member is fixed to a case of a developing device using a dedicate attachment such as a fastening mechanism.

Aspects of non-limiting embodiments of the present disclosure further relate to a developing device that may be formed smaller than a developing device including a large heat sink.

Aspects of non-limiting embodiments of the present disclosure further relate to a developing device capable of lowering the temperature of a developer passing through the vicinity of a communication pore as compared with a developing device in which a portion of a transporting path adjacent to a communication hole is made of a material having the same heat conductivity as other portions of a case.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided a developing device including: a case in which a hollow transporting path is formed; a transporting member configured to transport a developer in the transporting path; a support portion fixed to an end portion of the case by a fastening member to support the transporting member at an end portion of the transporting path; and a cooling unit fixed by being sandwiched between the support portion and the case.

According to another aspect of the present disclosure, there is provided a developing device including: a transporting path that is hollow and through which a developer is transported, wherein a part of a surface constituting the transporting path is formed by a cooling unit formed of a material having a heat conductivity higher than a heat conductivity of another part of the surface.

According to another aspect of the present disclosure, there is provided a developing device including: a case having a first transporting path and a second transporting path adjacent to the first transporting path; a first transporting member and a second transporting member configured to transport a developer so as to circulate the developer between the first transporting path and the second transporting path via a communication hole; and a cooling unit disposed at a position adjacent to the communication hole in the case and formed of a material having a heat conductivity higher than a heat conductivity of the case.

BRIEF DESCRIPTION OF THE DRAWINGS

Exemplary embodiment(s) of the present invention will be described in detail based on the following figures, wherein.

DETAILED DESCRIPTION

Figure 1:
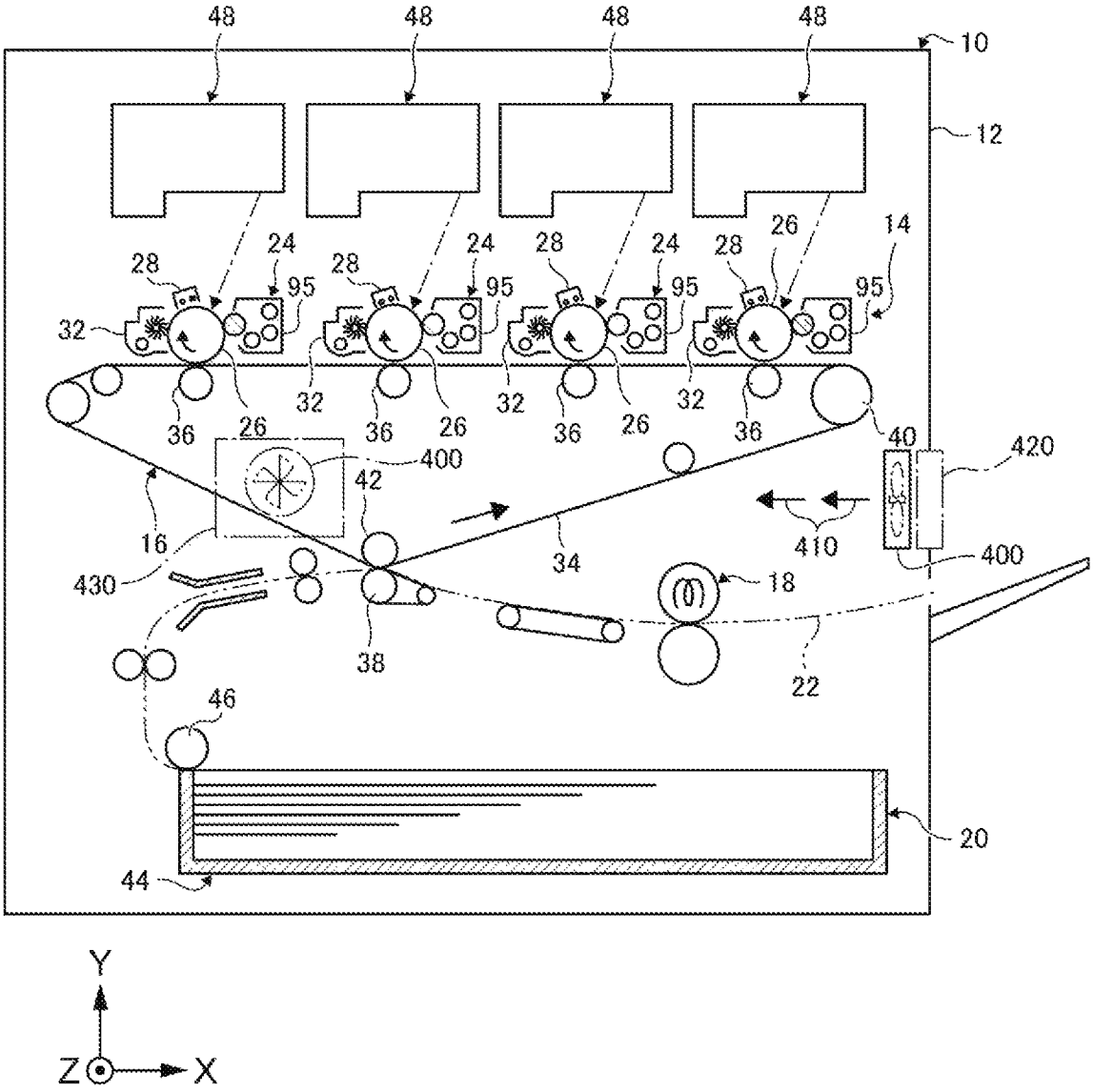
FIG. 1 is a side view illustrating a configuration of an image forming apparatus according to an exemplary embodiment of the present invention.

Hereinafter, an exemplary embodiment of the present invention will be described with reference to the drawings. The same components and processes are denoted by the same reference numerals throughout the drawings, and redundant description thereof will be omitted.

Figure 2:
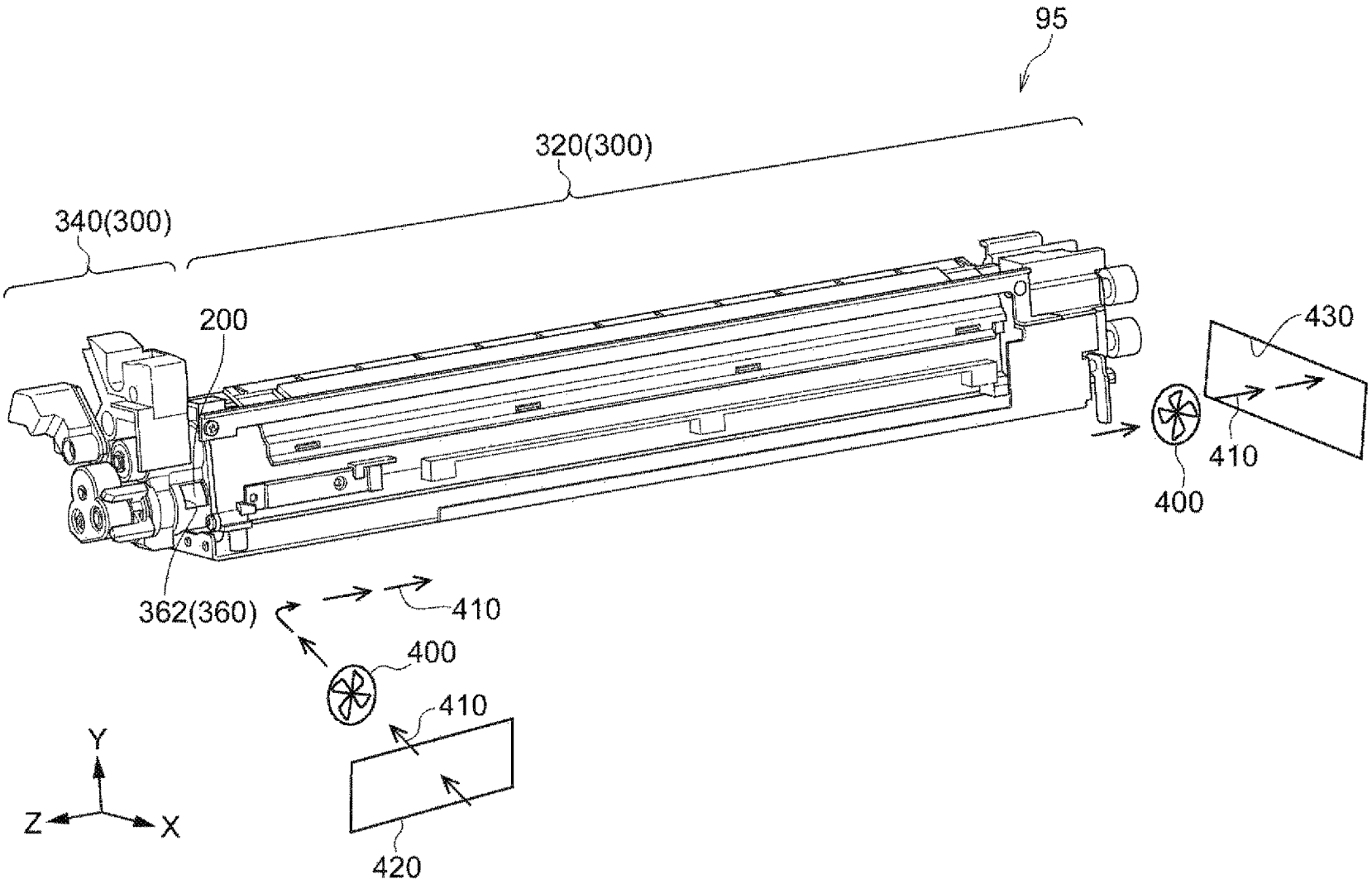
FIG. 2 is an external perspective view illustrating a developing device according to the exemplary embodiment of the present invention.
Figure 3:
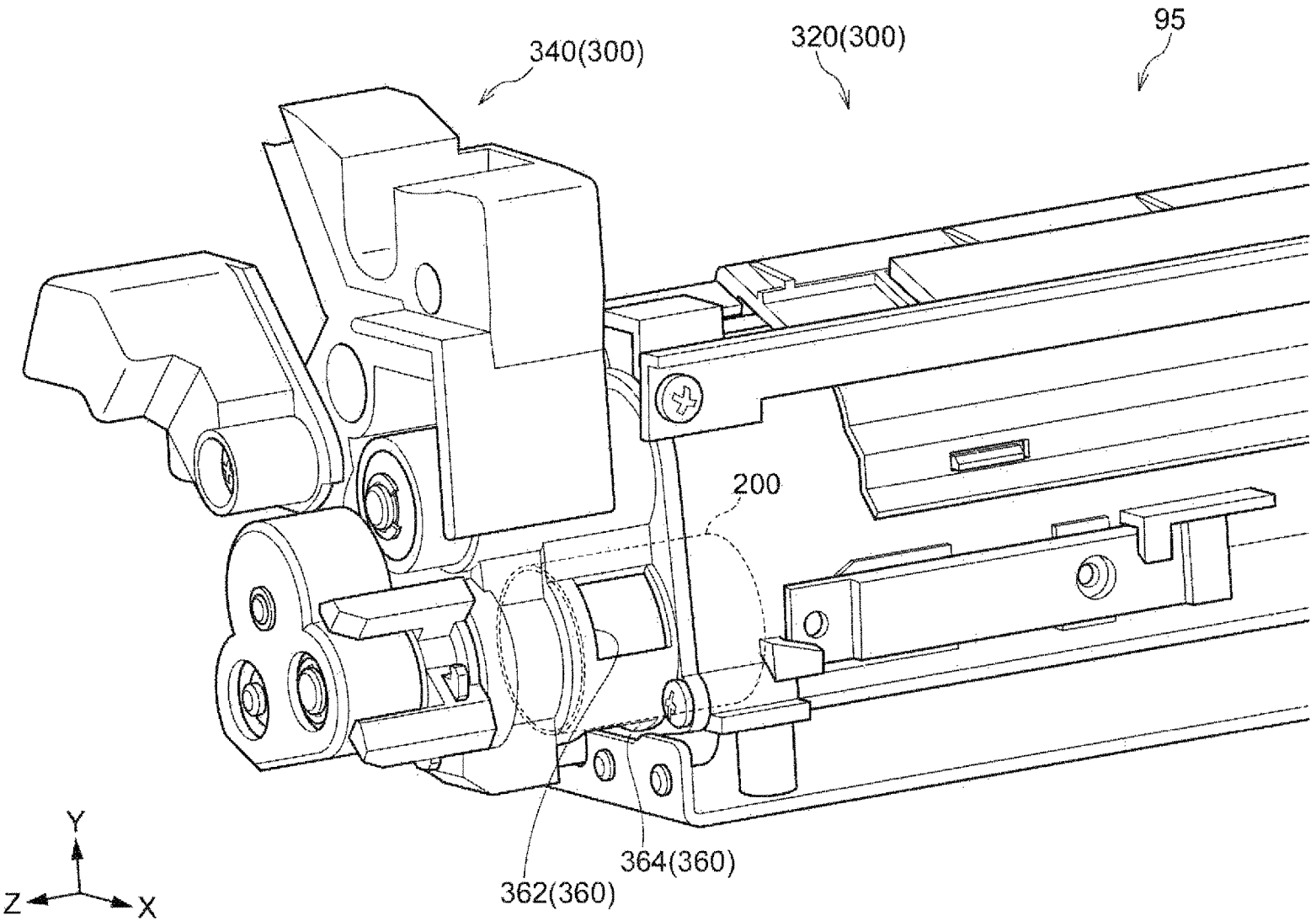
FIG. 3 is an external perspective view illustrating an end portion of the developing device including a support portion according to the exemplary embodiment of the present invention.
Figure 4:
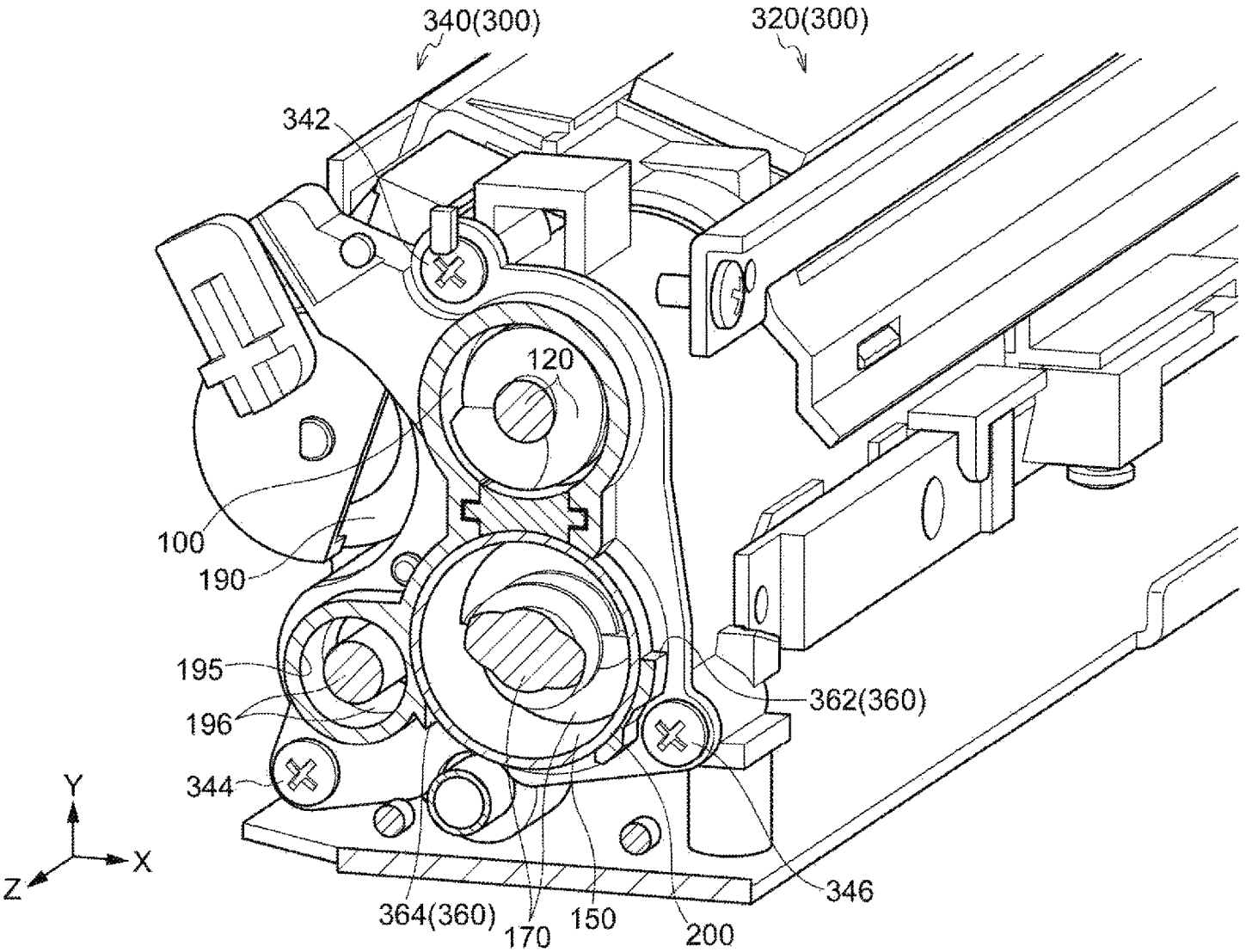
FIG. 4 is an external perspective view including a longitudinal section of the developing device according to the exemplary embodiment of the present invention.
Figure 5:
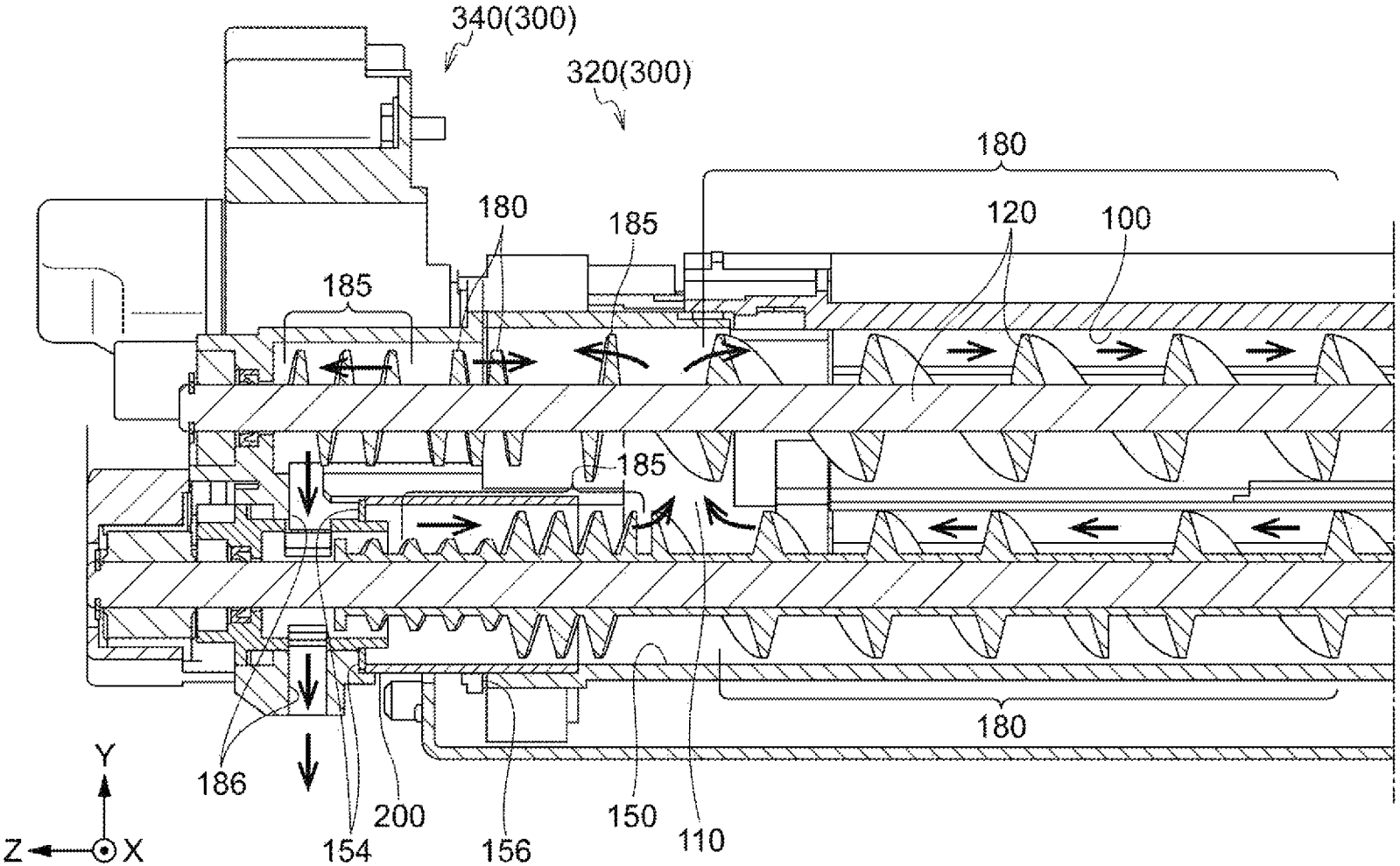
FIG. 5 is a longitudinal sectional view illustrating the developing device according to the exemplary embodiment of the present invention.
Figure 6:
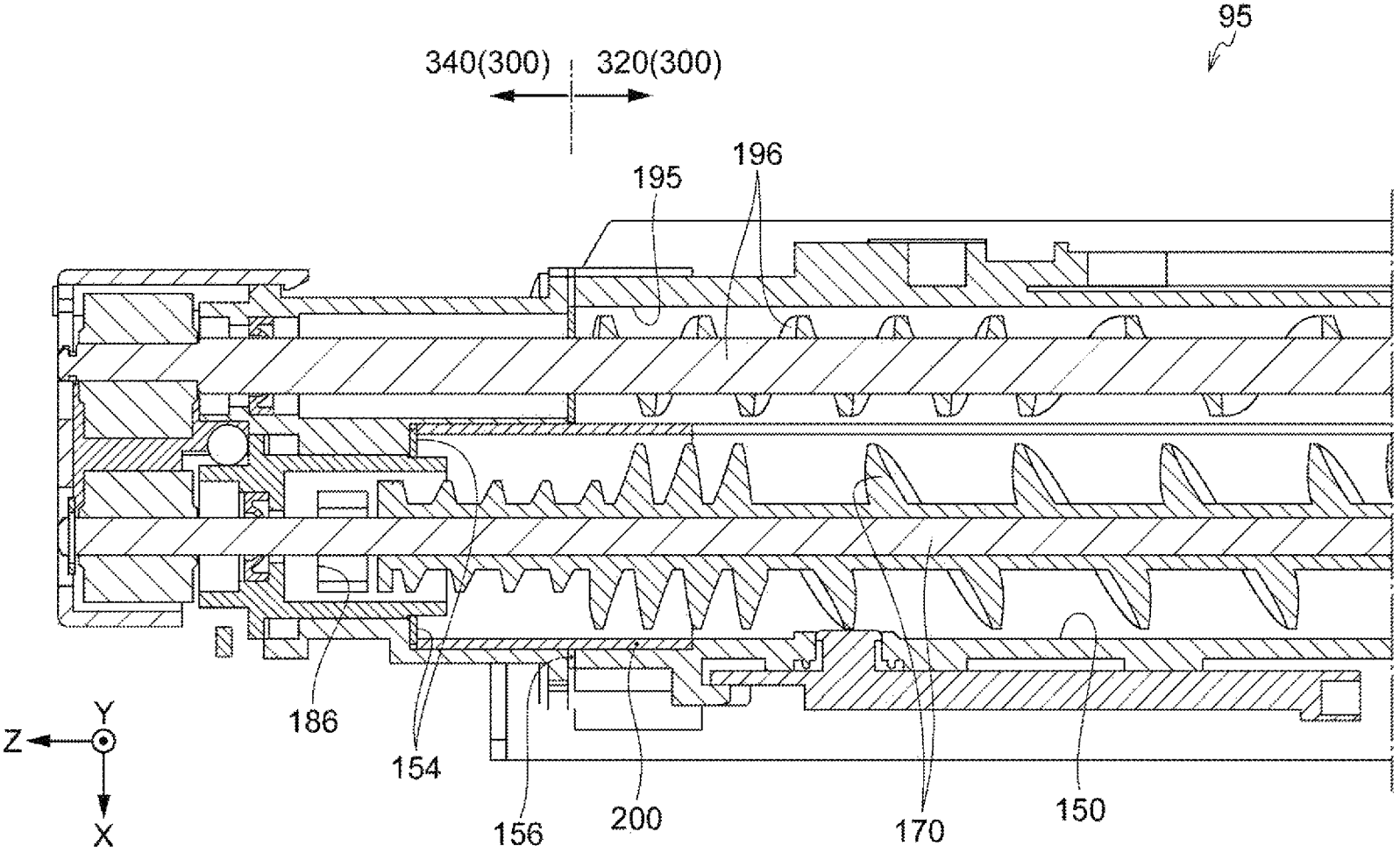
FIG. 6 is a horizontal sectional view illustrating the developing device according to the exemplary embodiment of the present invention.
Figure 7:
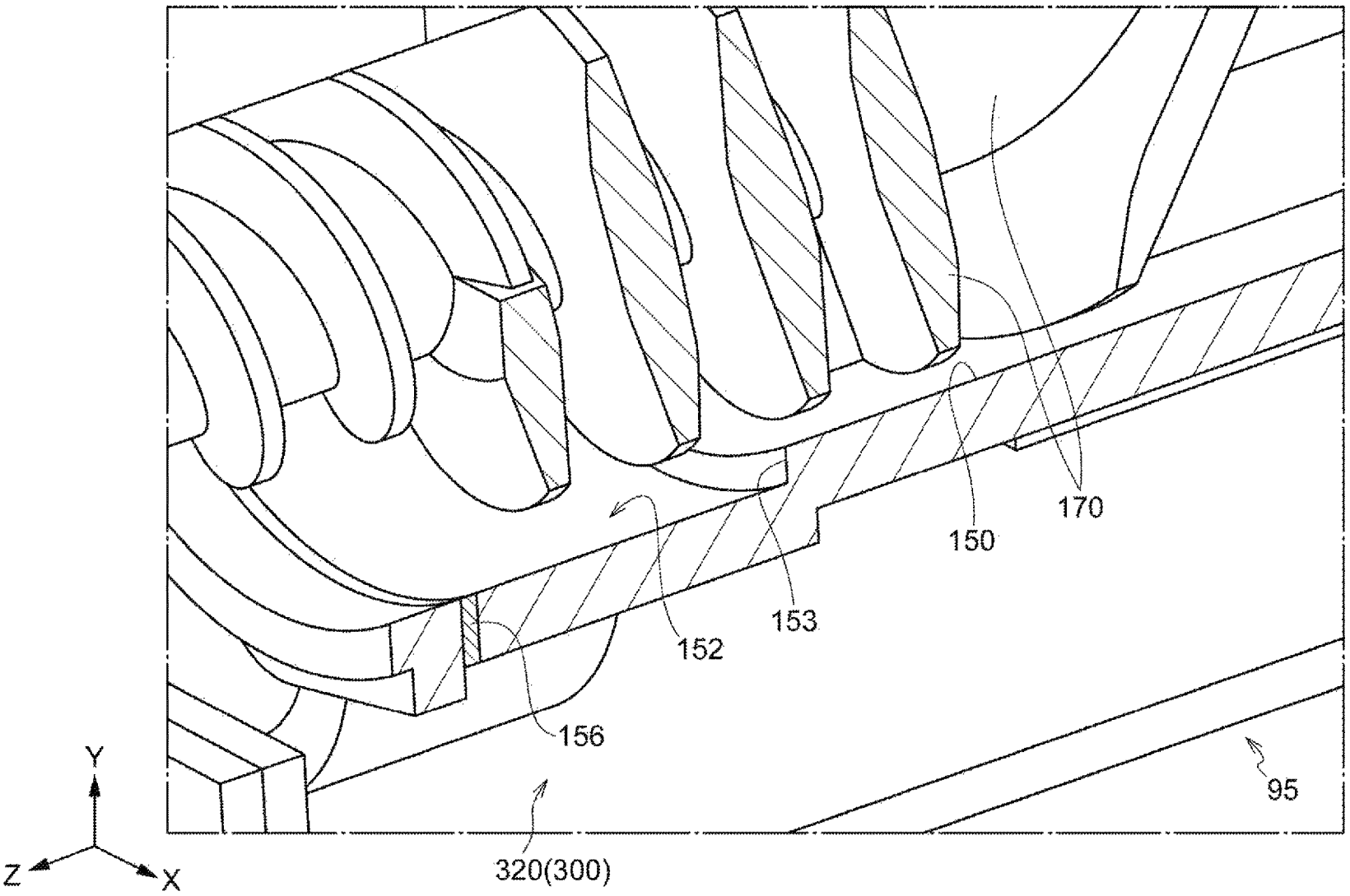
FIG. 7 is a longitudinal sectional view illustrating a second transporting path from which a cooling unit is removed and a transporting member according to the exemplary embodiment of the present invention.
Figure 8:
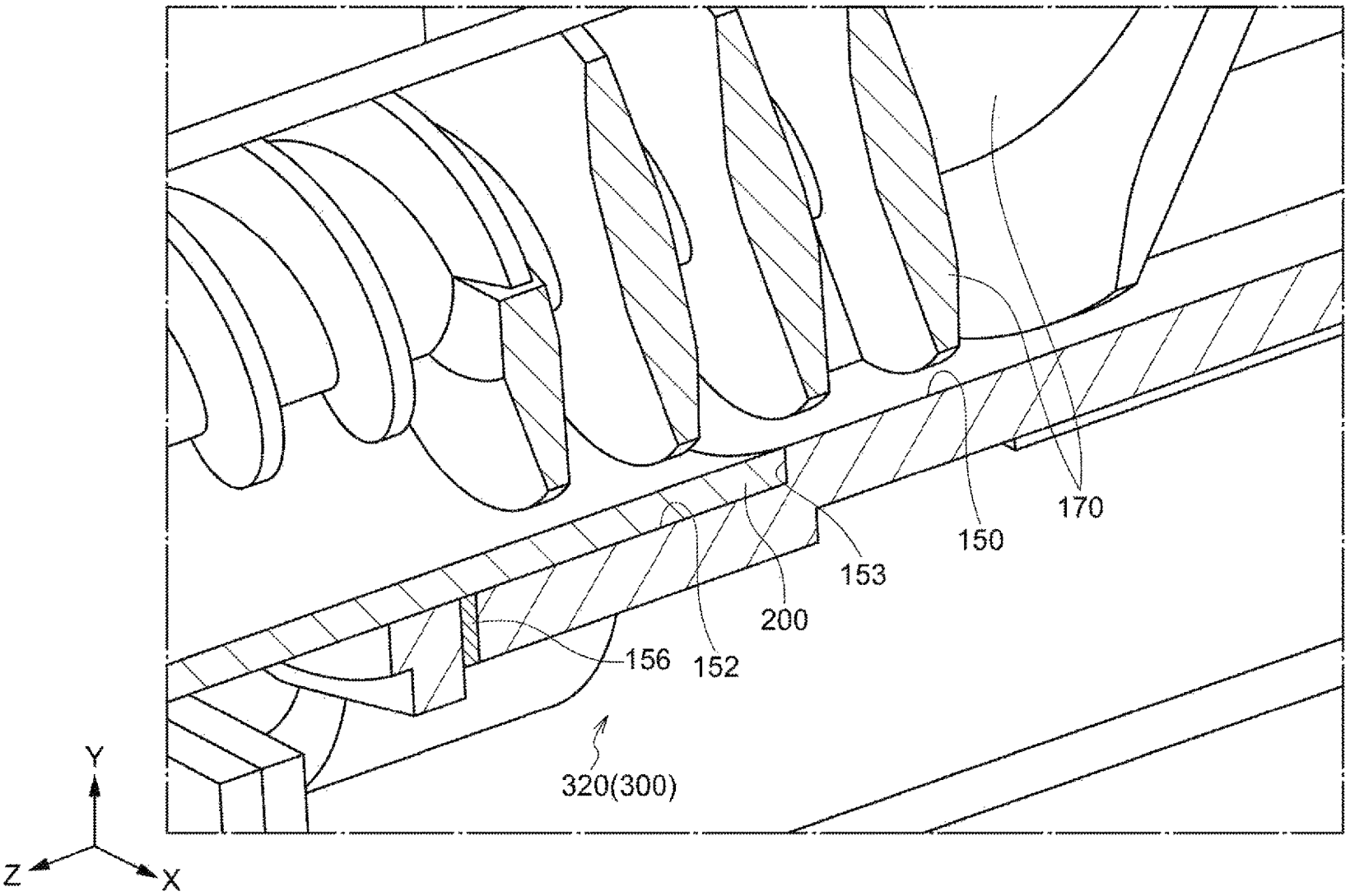
FIG. 8 is a longitudinal sectional view illustrating the second transporting path to which the cooling unit is attached and the transporting member according to the exemplary embodiment of the present invention.
Figure 9:
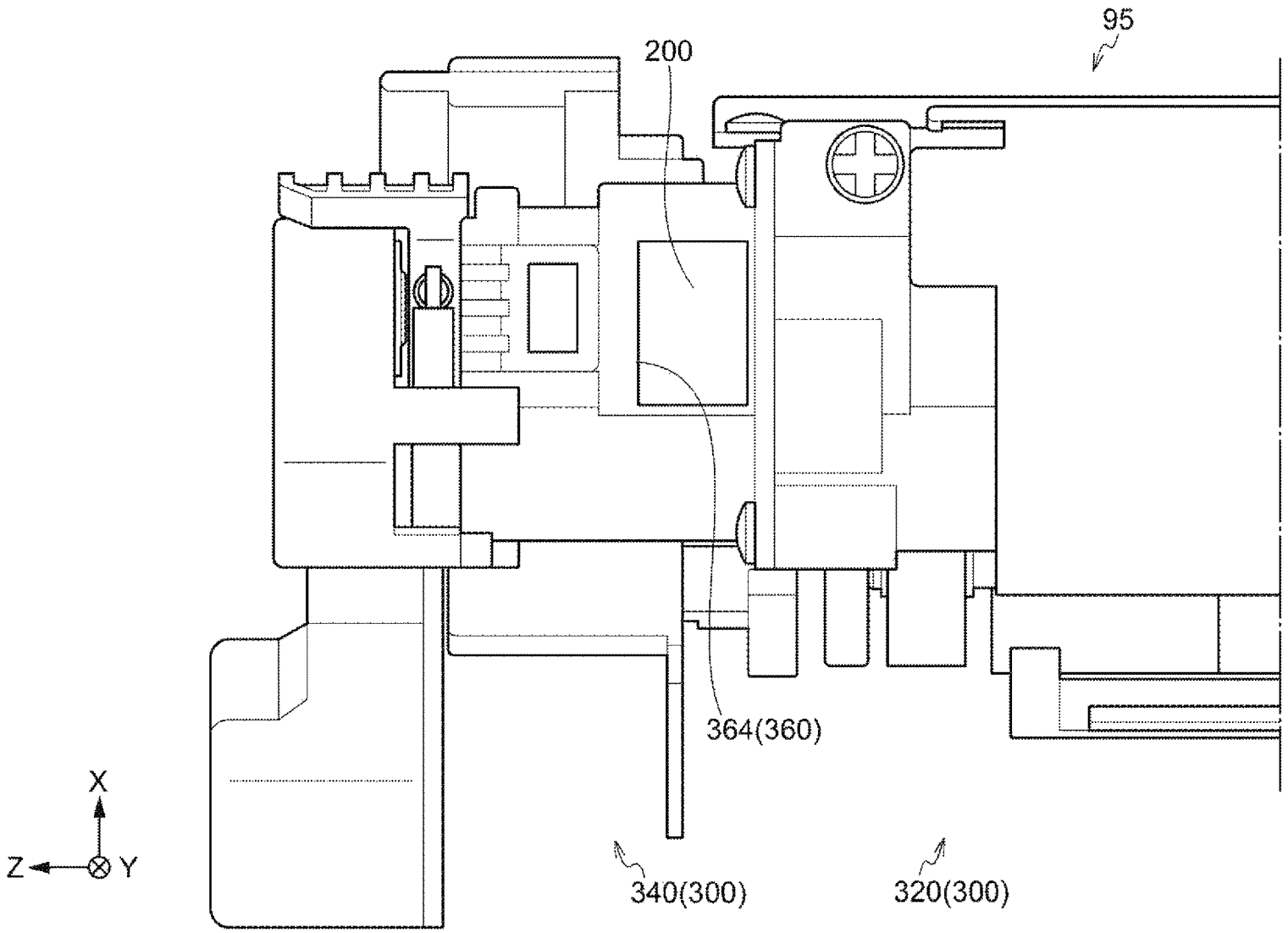
FIG. 9 is a rear view illustrating the end portion of the developing device according to the exemplary embodiment of the present invention.
Figure 10:
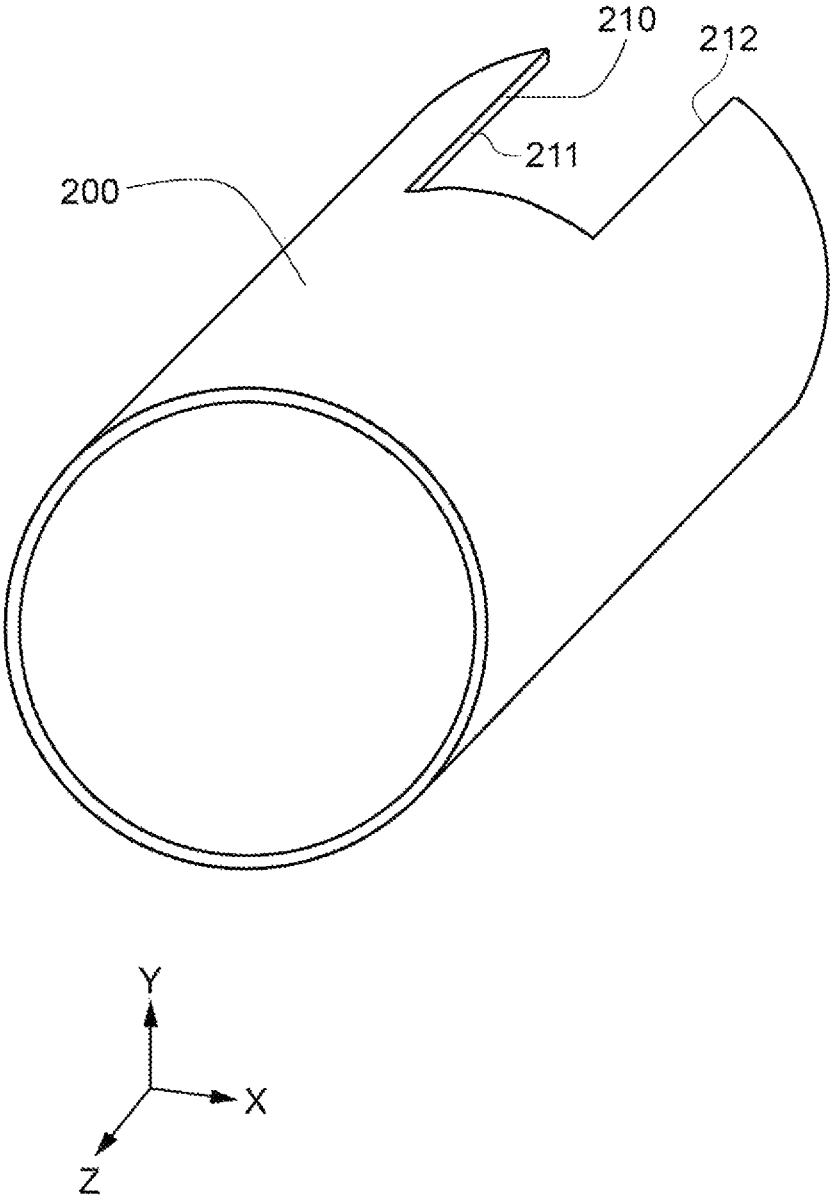
FIG. 10 is an external perspective view illustrating an example of another cooling unit according to the exemplary embodiment of the present invention.

FIG. 1 is a side view illustrating a configuration of an image forming apparatus; FIG. 2 is an external perspective view illustrating a developing device; FIG. 3 is an external perspective view illustrating an end portion of the developing device including a support portion; FIG. 4 is an external perspective view including a longitudinal section of the developing device; FIG. 5 is a longitudinal sectional view illustrating the developing device; FIG. 6 is a horizontal sectional view illustrating the developing device; FIG. 7 is a longitudinal sectional view illustrating a second transporting path from which a cooling unit is removed and a transporting member; FIG. 8 is a longitudinal sectional view illustrating the second transporting path to which the cooling unit is attached and the transporting member; FIG. 9 is a rear view illustrating the end portion of the developing device; and FIG. 10 is an external perspective view illustrating an example of another cooling unit.

Next, the exemplary embodiment of the present invention will be described with reference to the drawings. FIG. 1 illustrates an image forming apparatus 10 used in the exemplary embodiment of the present invention. The image forming apparatus 10 includes an image forming apparatus body 12, and an image forming device 14, a transfer device 16, a fixing device 18, and a sheet feeding device 20 are disposed in the image forming apparatus body 12. A transporting passage 22 for transporting a recording medium such as a paper sheet is formed in the image forming apparatus body 12.

In this specification and the drawings, for the sake of convenience, a left-right direction of the image forming apparatus 10 in FIG. 1 is indicated as an X-axis direction, a height direction is indicated as a Y-axis direction, and a direction orthogonal to the X-axis direction and the Y-axis direction is indicated as a Z-axis direction. In FIG. 1, the right direction is defined as a positive side in the X-axis direction, the upper direction is defined as a positive side in the Y-axis direction, and the front direction is defined as a positive side in the Z-axis direction. Other drawings are described in the same directions.

The image forming device 14 adopts an electrophotographic process to form an image on a recording medium. The image forming device 14 includes, for example, plural image forming units 24, such as four image forming units 24. The four image forming units 24 form toner images of different colors such as yellow, magenta, cyan, and black.

The image forming unit 24 includes a photoconductor drum 26. The photoconductor drum 26 is an example of an image carrier. The photoconductor drum 26 carries and rotates the toner image transferred to the recording medium on an outer peripheral surface. The image forming unit 24 is provided with a charging device 28 that charges the photoconductor drum 26, a developing device 95 that develops the charged latent image with toner, and a cleaning device 32 that cleans the photoconductor drum 26 after the transfer. An optical writing device 48 that forms a latent image on the charged photoconductor drum 26 is further provided.

The transfer device 16 includes an intermediate transfer belt 34. A toner image is primarily transferred from the photoconductor drum 26 to the intermediate transfer belt 34 by a primary transfer member 36, and the primarily transferred toner image is secondarily transferred to a recording medium by a secondary transfer member 38.

The intermediate transfer belt 34 is supported so as to be rotatable by plural support members 40. Further, a backup member 42 is provided to face the secondary transfer member 38.

The fixing device 18 fixes the toner image transferred onto the recording medium to the recording medium by using, for example, heat and pressure.

The sheet feeding device 20 includes a storage unit 44 that stores recording media in a stacked manner, and a delivery member 46 that delivers a recording medium stored in the storage unit 44 toward the transporting passage 22.

The transporting passage 22 transports a recording medium from the sheet feeding device 20 to between the secondary transfer member 38 and the backup member 42, transports the recording medium to the fixing device 18, and further transports the recording medium so as to be discharged to an outside of the image forming apparatus body 12.

In the image forming apparatus 10 configured as described above, the toner image formed on the outer peripheral surface of the photoconductor drum 26 is primarily transferred onto the intermediate transfer belt 34, the toner image primarily transferred onto the intermediate transfer belt 34 is secondarily transferred onto the recording medium, and the toner image secondarily transferred onto the recording medium is fixed on the recording medium by the fixing device 18.

In the image forming apparatus 10 according to the present exemplary embodiment, the developing device 95 that develops an electrostatic latent image formed on the electrostatic latent image carrier of the photoconductor drum 26 is used. As the developing device 95, for example, a two-component developer (hereinafter, simply referred to as a developer) including a carrier having magnetism and a toner mainly containing a resin is contained in a case 300 (housing) having a developing opening facing the electrostatic latent image carrier (photoconductor drum 26), and a developing roll 190 as a developing carrier is disposed at a position facing the developing opening of the case 300 as the housing. An auger serving as a transporting member that transports the developer in the transporting path in the case 300 (housing) to the developing roll while stirring and transporting the developer is disposed on a back side of the developing roll 190.

As illustrated in FIGS. 1 to 9, the developing device 95 according to the present exemplary embodiment includes the housing 300 as a case that is open at a portion facing the photoconductor drum 26 and contains a developer. The developing roll 190 as a developing member, which is a developer carrier, is disposed so as to face the opening of the housing 300. Inside the housing 300 as an example of the case, a first transporting path 100 that contains the developer so as to be able to supply the developer to the developing roll 190 is provided at a portion adjacent to the developing roll 190, and a second transporting path 150 that contains the developer so as to be able to supply the developer to the first transporting path 100 is disposed adjacent to the first transporting path 100 and. As illustrated in FIG. 4, the first transporting path 100 and the second transporting path 150 are disposed adjacent to each other vertically in the direction of gravity, and the second transporting path 150 is formed so as to be positioned below the first transporting path 100.

Here, the first transporting path 100 and the second transporting path 150 are partitioned from each other via a partition wall, and communicate with each other at both end portions in an axial direction. Specifically, a communication hole 110 (see FIG. 5) is formed at an end portion on a front side, and a communication hole (not shown) is formed at an end portion on a back side. In the housing 300, the developer circulates in the order of the second transporting path 150, the communication hole 110 on the front side, the first transporting path 100, and the communication hole on the back side.

The developing device 95 includes a transporting member that applies a transporting force for circulating the developer in the housing 300. Specifically, the developing device 95 includes a supply auger 120 disposed in the first transporting path 100 and an admix auger 170 disposed in the second transporting path 150. The supply auger 120 is formed with a main winding portion 180 which is a spiral blade on an outer periphery of a shaft, and the supply auger 120 transports the developer in a predetermined axial direction (for example, a negative side in the Z-axis direction in FIG. 5) while supplying the developer to the developing roll 190 by rotating around the shaft. The admix auger 170 is formed with a main winding portion 180 which is a spiral blade on an outer periphery of a shaft, and the admix auger 170 transports the developer in a direction opposite to that of the supply auger 120 (for example, a positive side in the Z-axis direction in FIG. 5) while stirring the developer by rotating around the shaft. The supply auger 120 is an example of a first transporting member, and the admix auger 170 is an example of a second transporting member.

By the rotation of the supply auger 120 and the admix auger 170, a developer G circulates in the above-described paths. The second transporting path 150 extends to the front side of the communication hole 110, and in this portion, a portion in which a reverse winding portion 185, which is a spiral blade, is formed on an outer periphery of the shaft of the admix auger 170 is disposed. The reverse winding portion 185 applies a transporting force in a direction opposite to that of the main winding portion 180 to the developer, so that the developer transported to the communication hole 110 by the main winding portion is promoted to be lifted toward the communication hole 110.

On the other hand, the first transporting path 100 extends to the front side of the communication hole 110, and forms a part of a developer discharge path 186 through which excess developer is discharged. The developer discharge path 186 includes a part extending forward to the positive side in the Z-axis direction beyond the reverse winding portion 185 of the admix auger 170 than the communication hole 110 in the first transporting path 100, and a part extending downward from an end portion of the above part and vertically penetrating the second transporting path 150. Since the developer discharge path 186 is formed, a so-called trickle method is adopted in which the deteriorated developer is gradually discharged to the outside of the case 300. In the part of the developer discharge path 186 extending in the Z-axis direction, a portion in which a reverse winding portion 185 that applies a transporting force in a direction opposite to that of the main winding portion 180 of the supply auger 120 to the developer is formed is disposed.

In the present exemplary embodiment, a third transporting path 195 in which a counter auger 196 serving as a third transporting member is disposed is formed in the housing 300. The counter auger 196 rotates around the axis to return the developer that is not consumed by the developing roll 190 to the second transporting path 150.

The case 300 is formed by joining a body side housing 320 and an end portion side housing 340. In the body side housing 320, parts of the first transporting path 100 and the second transporting path 150 slightly closer to the front side than the communication hole 110 are formed. In the end portion side housing 340, the remaining parts of the first transporting path 100 and the second transporting path 150 are formed. The body side housing 320 and the end portion side housing 340 are fixed to each other by screwing fastening members 342, 344, 346 into the body side housing 320 (case) from the end portion side housing 340 side in an abutting state in which a seal member 156 is sandwiched between the end portions of the body side housing 320 and the end portion side housing 340.

As illustrated in FIGS. 3 to 6, in the present exemplary embodiment, the cooling unit 200 is disposed at a position adjacent to the communication hole 110 of the second transporting path 150. The cooling unit 200 is disposed on the front side of the communication hole 110 in the second transporting path 150. The cooling unit 200 is a pipe-shaped member made of aluminum or an aluminum alloy which is a material having a higher heat conductivity than the resin which is a material for the case 300. The cooling unit 200 is formed so as to cover an inner surface of the second transporting path 150 at an arrangement portion thereof and extend in a peripheral direction of the second transporting path 150. Specifically, the cooling unit 200 covers the reverse winding unit 185 of the admix auger 170 from the periphery.

The cooling unit 200 is fixed to the case 300 by being sandwiched between the body side housing 320 and the end portion side housing 340.

A specific description will be given below. A recessed portion 152 is formed in a portion of the body side housing 320 where the second transporting path 150 is formed. The recessed portion 152 is a portion having an inner diameter larger than that of the transporting path 150, and reaches an end portion of the end portion side housing 340 in the body side housing 320. An end portion of the recessed portion 152 on the side opposite to the end portion side housing 340 side is an abutting surface (inner surface) 153 facing the end portion side housing 340 side. A part of the cooling unit 200 on the negative side in the Z-axis direction is internally fitted into the recessed portion 152 in a state where the cooling unit 200 abuts against the abutting surface 153 of the recessed portion 152.

Another part of the cooling unit 200 is internally fitted into the end portion side housing 340. The seal member 154 is interposed between the end portion side housing 340 and the end portion of the cooling unit 200 opposite to the body side housing 320. A fastening load by the above-described fastening members 342, 344, 346 acts on the seal member 154. That is, as described above, the cooling unit 200 is fixed to the case 300 by being sandwiched between the body side housing 320 and the end portion side housing 340 by the fastening load of the fastening members 342, 344, 346.

Here, as illustrated in FIG. 8, a pipe inner diameter of the cooling unit 200 and an inner diameter of the second transporting path 150 are formed to be the same, and the inner surfaces of both are formed to be continuous without generating a step. However, the pipe inner diameter of the cooling unit 200 may be formed to be smaller than the inner diameter of the second transporting path 150. As a result, the developer transported by the reverse winding portion 185 is smoothly transported toward the communication hole 110.

An opening portion 360 through which the cooling unit 200 faces the outside of the housing is formed in a portion of the housing 300 located outside the cooling unit 200. The opening portion 360 is formed in a rectangular window shape penetrating the inside and the outside of the housing, so that the cooling unit 200 is configured to be able to come into contact with the air outside the case 300.

Here, in the present exemplary embodiment, the opening portion 360 is formed at two positions, that is, an upper opening portion 362 facing obliquely upward of the case 300 (housing) as shown in FIG. 2, and a lower opening portion 364 facing downward of the case 300 (housing) as shown in the rear view of FIG. 9. The opening portion 360 is provided on a surface of the second transporting path 150 parallel to a developer transporting direction (positive side in the Z-axis direction). In this exemplary embodiment, the upper opening portion 362 and the lower opening portion 364 are formed in the end portion side housing 340, and the seal member 156 is positioned at an edge of the end portion side housing 340 on the body side housing 320 side.

In the present exemplary embodiment, as illustrated in FIG. 2, an air intake unit 420 that sucks air into the image forming apparatus 10 and an air exhaust unit 430 that exhausts the air are provided. The air intake unit 420 is a portion that opens in the right side plate when the image forming apparatus 10 is viewed from the side illustrated in FIG. 1, and the air exhaust unit 430 is a portion that opens in the back side plate when the image forming apparatus 10 is viewed from the side illustrated in FIG. 1. In addition, as illustrated in FIG. 2, in a state where the developing device 95 is installed in an image processing apparatus 90, the cooling unit 200 is disposed not on the air exhaust unit 430 side but on the air intake unit 420 side. In addition, the air intake unit 420 includes a blowing device 400 that blows air toward the cooling unit 200. Therefore, the opening portion 360 is provided at a position in contact with an airflow generated inside the image forming apparatus 10 in a state where the developing device 95 is installed in the image forming apparatus 10. Here, the air intake unit 420 is the portion that opens in the right side plate when the image forming apparatus 10 is viewed from the side illustrated in FIG. 1, and the air exhaust unit 430 is the portion that opens in the back side plate when the image forming apparatus 10 is viewed from the side illustrated in FIG. 1. The number of the air intake unit 420 and the air exhaust unit 430 is not limited to one, and may be provided in each developing device 95. In addition, a duct connected from the air intake unit 420 to the opening portion 360 may be provided so that the air taken in from the air intake unit 420 is able to be easily sent to the cooling unit 200.

(First Aspect)

In the developing device 95, when the supply auger 120 and the admix auger 170 rotate, the developer circulates in the housing 300 in the order of the second transporting path 150, the communication hole 110 on the front side, the first transporting path 100, and the communication hole on the back side.

In the above-described exemplary embodiment, in order to change the transporting direction of the developer in the second transporting path 150 (from the negative side in the Z-axis direction to the positive side in the Z-axis direction in FIG. 5) to the transporting direction of the developer in the first transporting path 100 (from the positive side in the Z-axis direction to the negative side in the Z-axis direction in FIG. 5) and to move the developer upward into the first transporting path 100 on the upper side, it is necessary to apply pressure to the developer in the vicinity of the communication hole 110 of the second transporting path 150. At this time, the temperature of the developer and the like increases due to generation of frictional heat accompanying an increase in frictional force between the developers.

In addition, when the transporting member such as an auger shaft is rotated at high speed without increasing the diameter in order to save the space of the image forming apparatus, heat is generated in the bearing and the driving system, and heat is likely to be generated in a portion in the vicinity of the communication hole where the developer stays.

In the exemplary embodiment, the cooling unit 200 is disposed adjacent to the communication hole 110. The cooling unit 200 has a heat conductivity higher than that of the housing 300.

According to the exemplary embodiment, as compared with a structure in which the cooling member 200 is fixed to the case 300 of the developing device 95 using a dedicated attachment such as a fastening mechanism, the cooling unit 200 may be fixed to the developing device 95 without requiring a special fastening mechanism or the like for fixing the cooling unit 200 separately. In addition, the structure of the developing device 95 may be simplified without complicating the structure.

According to the exemplary embodiment, as compared with a configuration in which the cooling unit 200 is sandwiched by the support portion 340 in a state where the cooling unit 200 is not pressed, the cooling unit 200 is pressed toward an inner surface of the recessed portion 152, and the cooling unit 200 is firmly sandwiched and fixed between the support portion 340 and the transporting path without being pushed by a dedicated fastening member.

According to the exemplary embodiment, as compared with a configuration in which positioning is not performed by abutting, and a seal member is not provided, positioning is easily performed by abutting the cooling unit 200 against the inner surface of the recessed portion 152, a gap is less likely to be generated, and entry of the developer is also prevented.

According to the exemplary embodiment, as compared with a configuration in which the support portion 340 and the support portion 340 side of the cooling unit 200 are in direct contact with each other, the developer may be prevented from entering between the cooling unit 200 and the support portion 340.

According to the exemplary embodiment, as compared with a configuration in which the cooling unit 200 has a plate shape, the cooling unit 200 is formed in a tubular shape, so that the developer comes into direct contact with the inner surface of the tubular shape, the heat of the developer is efficiently transmitted to the cooling unit 200, and the temperature of the developer may be efficiently lowered.

According to the exemplary embodiment, the image forming apparatus 10 having the function and effect of the developing device 95 according to any one of the aspects described above may be provided.

In addition, in the above-described exemplary embodiment, the opening portion 360 is provided not in the body side housing 320 but in the end portion side housing (support portion) 340. The end portion side housing (support portion) 340 is formed to be shorter than the elongated body side housing 320, so that the opening portion 360 is opened while maintaining the strength and rigidity of the housing.

In addition, in the above-described exemplary embodiment, as illustrated in FIG. 2, the air intake unit 420 is provided, so that cold fresh air outside the image forming apparatus 10 is taken into the image forming apparatus 10 from the air intake unit 420 by the blowing device 400. Then, the air flow directly comes into contact with the cooling unit 200.

As a result, the air, the temperature of which is increased due to taking in the heat released from the surface of the cooling unit 200, may be discharged from the air exhaust unit 430 to the outside of the image forming apparatus 10. In addition, a flow of air may be generated as illustrated in FIG. 2 inside the image forming apparatus 10, and the cooling effect of the cooling unit 200 may be increased without increasing the air temperature inside the image forming apparatus 10.

In addition, the cooling unit 200 according to the exemplary embodiment has a cylindrical pipe shape as a whole, and an opening, a notch, or the like is not formed, but the cooling unit 200 is not particularly limited to such a shape. Specifically, for example, as illustrated in FIG. 10, a cutout portion 210 may be provided at which a position corresponding to the communication hole 110 is cut out. In the case where the cutout portion 210 is provided, it is desirable that the communication hole 110 is disposed so as to be positioned between one side 211 and the other side 212 facing each other of the cutout portion 210. Note that, in the exemplary embodiment, the cutout portion 210 has a shape that is cut out at an end portion side of the cooling unit 200, but the position and shape of the cutout portion 210 are not particularly limited to the shape that is cut out at the end portion side, and the cutout portion 210 may be formed in a hole shape that opens further toward an inner side of the cooling unit 200.

As illustrated in FIG. 10, when the cooling unit 200 has the cutout portion 210 corresponding to the communication hole 110, the cooling unit 200 may be disposed close to the periphery of the communication hole 110, and the temperature increase around the communication hole 110 may be efficiently reduced.

Further, in the exemplary embodiment, the first transporting path 100 and the second transporting path 150 are arranged adjacent to each other vertically in the direction of gravity, that is, in a so-called vertical arrangement, but the present invention is not particularly limited to such a vertical arrangement. Specifically, for example, even in a horizontal arrangement in which plural transporting paths are arranged on the left and right in the direction of gravity instead of the vertical arrangement in which plural transporting paths are arranged vertically in the direction of gravity as described above, the same function and effect may be obtained and applicable even when the cooling unit 200 as described above is provided in a developing device in which a high speed rotation is performed to increase the efficiency and the temperature of the developer is expected to increase due to a frictional force.

(Second Aspect)

According to the exemplary embodiment, the developing device 95 that may be formed smaller than a developing device including a large heat sink is provided. Here, the cooling unit 200 is provided on a part of the inner surface of the second transporting path 150. For this reason, the cooling unit 200 may directly absorb heat from the developer whose temperature has increased, and further diffuse and dissipate the absorbed heat to the periphery of the case, so that the concentration of heat is reduced and the temperature increase of the developer and the like is reduced.

According to the exemplary embodiment, the cooling effect may be increased as compared with a case where the cooling unit 200 does not face the outside of the housing 300.

According to the exemplary embodiment, the opening portion 360 may be opened while maintaining the strength of the housing 300 as compared with a case where the opening portion 360 is provided in the elongated body side housing 320. That is, the end portion side housing (support portion) 340 is formed to be shorter than the elongated body side housing 320, so that the opening portion 360 is opened while maintaining the strength and rigidity of the housing.

According to the exemplary embodiment, leakage of the developer from a gap may be prevented as compared with a case where a seal member is disposed only between the body side housing 320 and the cooling unit 200.

According to the exemplary embodiment, the cooling effect of the cooling unit 200 may be increased as compared with a case where an airflow does not contact the cooling unit 200 facing the opening portion 360.

According to the exemplary embodiment, the cooling effect may be increased as compared with a case where the opening portion 360 is provided on a surface of the second transporting path 150 other than the surface parallel to the transporting direction of the developer.

According to the exemplary embodiment, the cooling effect may be increased as compared with a case where the cooling unit 200 is provided only at a part in the peripheral direction.

According to the exemplary embodiment, the cooling effect of the cooling unit 200 may be increased as compared with a case where the air from the blowing device 400 does not come into contact with the cooling unit 200.

According to the exemplary embodiment, the cooling effect of the cooling unit 200 may be increased as compared with a case where the cooling unit 200 is disposed on the air exhaust unit 430 side. That is, as illustrated in FIG. 2, the air intake unit 420 is provided, so that the cold fresh air outside the image forming apparatus 10 is taken into the image forming apparatus 10 from the air intake unit 420 by the blowing device 400. Then, the air flow directly comes into contact with the cooling unit 200. As a result, the air, the temperature of which is increased due to taking in the heat released from the surface of the cooling unit 200, may be discharged from the air exhaust unit 430 to the outside of the image forming apparatus 10. In addition, a flow of air may be generated as illustrated in FIG. 2 inside the image forming apparatus 10, and the cooling effect of the cooling unit 200 may be increased without increasing the air temperature inside the image forming apparatus 10.

In the above-described exemplary embodiment, as illustrated in FIGS. 5 and 6, the cooling unit 200 is provided from a position adjacent to the communication hole 110 to a position corresponding to the developer discharge path 186. As a result, an increase in temperature in the vicinity of the developer discharge path 186 may be reduced, the developer discharge path 186 to which the developer is discharged may be prevented from becoming functional failure, and the function of discharging excess developer may be maintained.

In the above-described exemplary embodiment, as illustrated in FIGS. 3, 5, and 6, when the support portion 340 is fixed to the end portion of the case 300 by the fastening members (342, 344, and 346), the cooling unit 200 is sandwiched between the support portion 340 and the case 300, and the support portion 340 is fixed to the case 300 by the fastening members (342, 344, and 346).

Accordingly, as compared with a structure in which the cooling unit 200 is fixed to the case 300 of the developing device 95 using a dedicated attachment such as a fastening mechanism, the cooling unit 200 may be fixed to the developing device 95 without requiring a special fastening mechanism or the like for fixing the cooling unit 200 separately. In addition, the structure of the developing device 95 may be simplified without complicating the structure.

(Third Aspect)

According to the exemplary embodiment, the temperature of the developer passing through the vicinity of the communication hole 110 may be lowered as compared with a case where a portion of the second transporting path 150 adjacent to the communication hole 110 is made of a material having the same heat conductivity as other portions of the case 300.

According to the exemplary embodiment, an increase in temperature may be effectively reduced as compared with a case where the cooling unit 200 is disposed only in the first transporting path 100.

According to the exemplary embodiment, in the configuration in which the second transporting path 150 is disposed on the lower side of the first transporting path 100 in the direction of gravity, the temperature of the developer passing through the vicinity of the communication hole 110 may be lowered as compared to a configuration in which the second transporting path 150 is made of a material having the same heat conductivity as that of a portion of the transporting path adjacent to the communication hole 110.

According to the exemplary embodiment, as compared with a configuration in which the cooling unit is disposed only adjacent to the communication hole 110 through which the developer moves from the first transporting path 100 to the second transporting path 150, the temperature is likely to increase in the vicinity of the communication hole 110 through which the developer is lifted up and transported, and therefore, the temperature of the developer passing through the vicinity of the communication hole 110 may be efficiently lowered.

According to the exemplary embodiment, as compared with a configuration in which the cooling unit has a plate shape, the cooling portion 200 is a pipe-shaped member, so that the developer comes into direct contact with the cooling unit 200, and therefore, the temperature of the developer passing through the vicinity of the communication hole 110 may be lowered.

According to the exemplary embodiment, as compared with a configuration in which the cooling unit 200 is disposed to be shifted from the communication hole 110, the cooling unit 200 may be disposed close to the periphery of the communication hole 110, and the temperature of the developer passing through the vicinity of the communication hole 110 may be lowered.

According to the exemplary embodiment, as compared with a configuration in which the cooling unit is disposed so as to be shifted from the reverse winding portion, a temperature increase in a portion where the temperature increase due to collision and friction of the developer becomes large is reduced, and the temperature of the developer passing through the vicinity of the communication hole may be reduced.

According to the exemplary embodiment, as compared with a case where the cooling unit 200 is disposed only in the vicinity of the communication hole 110, the temperature increase in the vicinity of the developer discharge path 186 may be reduced, and the discharge failure of the excess developer may be prevented.

According to the exemplary embodiment, the image forming apparatus 10 including the developing device 95 according to any one of the aspects described above may be provided.

In the exemplary embodiment, the communication hole 110 through which the developer is lifted upward and moves from the second transporting path 150 to the first transporting path 100, and the communication hole (not illustrated) through which the developer falls down and moves from the first transporting path 100 to the second transporting path 150 are provided. As illustrated in FIG. 5, the cooling unit 200 is provided at a position adjacent to, among the two communication holes, the communication hole 110 through which the developer is lifted upward and moves from the second transporting path 150 to the first transporting path 100. Since the developer may move by natural dropping through the communication hole (not illustrated) through which the developer falls down without applying a special pressure or the like to the developer, a large frictional load is not applied to the developer, and the generation of frictional heat is also small. Therefore, it is not necessary to provide the cooling unit 200 on the side of the communication hole (not illustrated) through which the developer falls down, and the cooling unit 200 is not provided. On the other hand, in the vicinity of the communication hole 110 through which the developer is lifted upward and moves from the second transporting path 150 to the first transporting path 100 via the communication hole 110, it is necessary to apply pressure by pressing the developer in order to lift the developer from the second transporting path 150 on the lower side to the first transporting path 100 on the upper side against gravity. At such a position, the frictional force between the developers increases, and the temperature in the vicinity tends to increase due to the frictional heat. By providing the cooling unit 200 at a position adjacent to the communication hole 110 where the temperature easily increases, the temperature increase in the vicinity of the communication hole 110 may be efficiently reduced.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A developing device comprising:

a case in which a hollow transporting path is formed;

a transporting member configured to transport a developer in the transporting path;

a support portion fixed to an end portion of the case by a fastening member to support the transporting member at an end portion of the transporting path; and a cooling unit fixed by being sandwiched between the support portion and the case, wherein the cooling unit is fixed by being sandwiched between the support portion and the transporting path in a state of being pressed against an inner surface, facing a transporting direction of the developer, of a recessed portion provided along the transporting path inside the case.

2. The developing device according to claim 1,
wherein the cooling unit is made of aluminum or an aluminum alloy, and is formed in a tubular shape covering the inner surface.

3. The developing device according to claim 1,
wherein the cooling unit is positioned by being brought into contact with the inner surface of the recessed portion, and
the developing device further comprises a seal member on a support portion side of the cooling unit.

4. The developing device according to claim 3,
wherein the seal member is provided between the support portion and the support portion side of the cooling unit.

5. A developing device comprising:
a transporting path that is hollow and through which a developer is transported, wherein:
a part of a surface constituting the transporting path is formed by a cooling unit formed of a material having a heat conductivity higher than a heat conductivity of another part of the surface,
the transporting path is covered with a housing,
a portion of the housing located outside the cooling unit is provided with an opening portion through which the cooling unit faces an outside of the housing,
the housing includes:
an elongated body side housing and
an end portion side housing positioned at one end portion of the body side housing, and
the opening portion is provided on the end portion side housing.

6. The developing device according to claim 5, further comprising
a seal member provided at a portion where the cooling unit and the end portion side housing are in contact with each other.

7. The developing device according to claim 5,
wherein, in a state where the developing device is installed in an image forming apparatus, the opening portion is provided at a position in contact with an air flow generated inside the image forming apparatus.

8. The developing device according to claim 5,
wherein the opening portion is provided on a surface of the housing parallel to a transporting direction of the developer in the transporting path.

9. The developing device according to claim 5,
wherein the cooling unit is formed in a pipe shape extending in a peripheral direction of the transporting path.

10. A developing device comprising:
a case having a first transporting path and a second transporting path adjacent to the first transporting path;
a first transporting member and a second transporting member configured to transport a developer so as to circulate the developer between the first transporting path and the second transporting path via a communication hole; and
a cooling unit disposed at a position adjacent to the communication hole in the case and formed of a material having a heat conductivity higher than a heat conductivity of the case, wherein:
the first transporting member is formed so as to supply the developer to surroundings,
the second transporting member is formed so as to stir the developer, and
the cooling unit is disposed in the second transporting path.

11. The developing device according to claim 10,
wherein the cooling unit is a pipe-shaped member that covers an inner surface of the second transporting path.

12. The developing device according to claim 10,
wherein the cooling unit includes a cutout portion corresponding to the communication hole.

13. The developing device according to claim 10,
wherein the second transporting member includes
a main winding portion formed to be wound in a direction to circulate the developer at an end portion of the second transporting member, and
a reverse winding portion wound in an opposite direction to the direction in which the main winding portion is wound at an other end portion of the second transporting member opposite to the end portion at which the main winding portion is formed across the communication hole, and
the cooling unit is disposed from a position adjacent to the communication hole to a position corresponding to the reverse winding portion in the second transporting path.

14. The developing device according to claim 10,
wherein a developer discharge path through which an excess of the developer is discharged out from a range in which the developer circulates through the communication hole is discharged to an outside is disposed in the first transporting path, and
the cooling unit is disposed from the position adjacent to the communication hole to a position adjacent to the developer discharge path.

15. The developing device according to claim 10,
wherein the first transporting path and the second transporting path are disposed adjacent to each other vertically, and the second transporting path is located below the first transporting path.

16. The developing device according to claim 15,
wherein the cooling unit is disposed adjacent to the communication hole through which the developer is lifted upward and moves from the second transporting path to the first transporting path.

* * * * *